US008284966B2

(12) United States Patent
Wilk et al.

(10) Patent No.: US 8,284,966 B2
(45) Date of Patent: Oct. 9, 2012

(54) ELASTOMERIC SHIELD FOR MINIATURE MICROPHONES

(75) Inventors: Christopher Wilk, Toronto (CA); Bjarke Pihl Bovbjerg, Horsens (DK); Tapio Juhani Liusvaara, Tampere (FI)

(73) Assignee: Sonion Mems A/S, Roskilde (DK)

( * ) Notice: Subject to any disclaimer, the term of this patent is extended or adjusted under 35 U.S.C. 154(b) by 1365 days.

(21) Appl. No.: 11/657,806

(22) Filed: Jan. 25, 2007

(65) Prior Publication Data

US 2007/0189568 A1 Aug. 16, 2007

Related U.S. Application Data

(60) Provisional application No. 60/763,089, filed on Jan. 26, 2006.

(51) Int. Cl.
*H04R 25/00* (2006.01)

(52) U.S. Cl. ..... 381/189; 381/355; 381/361; 381/365; 381/368

(58) Field of Classification Search ..... 381/355–369, 381/170–181
See application file for complete search history.

(56) References Cited

U.S. PATENT DOCUMENTS

| | | | | |
|---|---|---|---|---|
| 4,163,875 | A | 8/1979 | Cogan | 179/103 |
| 4,525,817 | A * | 6/1985 | Takuya | 367/140 |
| 5,937,361 | A * | 8/1999 | Smith | 455/575.1 |
| 6,201,876 | B1 * | 3/2001 | Niemi et al. | 381/355 |
| 7,054,458 | B2 * | 5/2006 | Ito et al. | 381/355 |
| 7,602,932 | B2 * | 10/2009 | Kobayashi | 381/361 |
| 7,657,052 | B2 * | 2/2010 | Larson et al. | 381/365 |
| 7,797,025 | B2 * | 9/2010 | Hawker et al. | 455/575.1 |
| 2005/0077102 | A1 | 4/2005 | Banter et al. | |

FOREIGN PATENT DOCUMENTS

| | | | |
|---|---|---|---|
| EP | 0 888 031 A1 | | 12/1998 |
| JP | 06078040 A | * | 3/1994 |
| WO | WO 95/05715 | | 2/1995 |
| WO | WO 95/27323 | | 10/1995 |
| WO | WO 02/45463 A2 | | 6/2002 |
| WO | 2005/039234 A2 | | 4/2005 |

OTHER PUBLICATIONS

Chinese Office Action corresponding to Chinese Patent Application No. 200710008148.X, Chinese Intellectual Property Office, dated Jul. 5, 2011, 7 pages.

European Search Report corresponding to European Patent Application Serial No. EP 07 00 1294, European Patent Office, dated Apr. 11, 2007, 2 pages.

* cited by examiner

*Primary Examiner* — Curtis Kuntz
*Assistant Examiner* — Ryan Robinson
(74) *Attorney, Agent, or Firm* — Nixon Peabody LLP

(57) ABSTRACT

An elastic shield comprising an acoustic channel having a sound inlet and a sound outlet, and a hollow portion being adapted to at least partly surround a miniature microphone, or alternatively, arranged to follow an outer contour of a miniature microphone. The present invention further relates to a miniature microphone assembly comprising a miniature microphone having a sound inlet, and an elastic shield comprising an acoustic channel having a sound inlet and a sound outlet, the elastic shield further comprising a hollow portion housing at least part of the miniature microphone in a manner so that the sound outlet of the acoustic channel is aligned with the sound inlet of the miniature microphone.

13 Claims, 3 Drawing Sheets

ELASTOMERIC SHIELD FOR MINIATURE MICROPHONES

CROSS-REFERENCE TO RELATED APPLICATION

Figure 1:
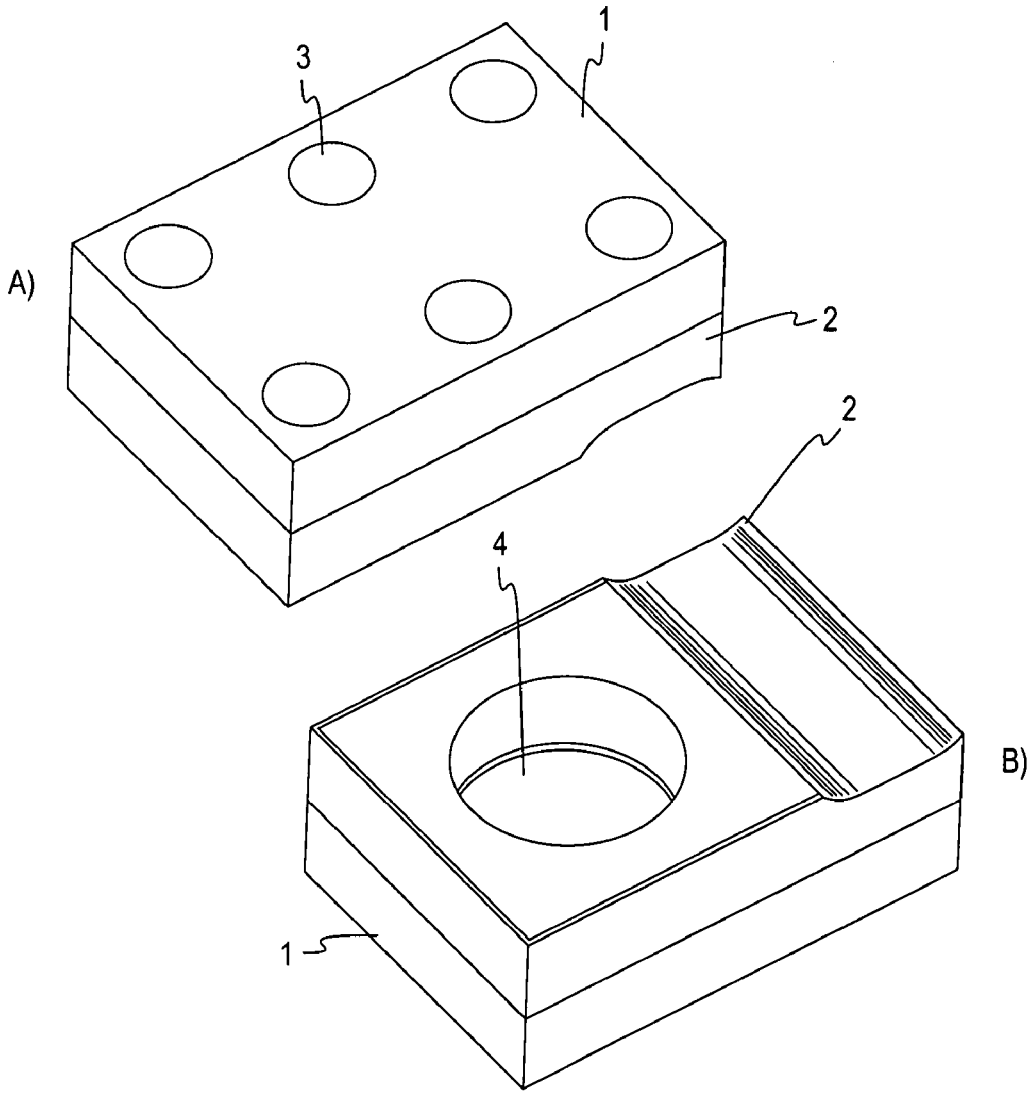

This application claims the benefit of U.S. Provisional Application No. 60/763,089, entitled "An Elastomeric Shield For Miniature Microphones," filed Jan. 26, 2006.

FIELD OF THE INVENTION

The present invention relates to an elastic microphone shield suitable for establishing an acoustic seal between an acoustic channel and an interior volume of a housing of a portable communication device. The sealed acoustic channel is arranged to transmit acoustical signals from a sound inlet in the housing of the portable communication device to a sound inlet of a miniature microphone arranged on, for example, a suitable carrier within the interior volume of the housing of the portable communication device.

BACKGROUND OF THE INVENTION

In prior art systems acoustic sealing between a sound inlet of a microphone and a housing of for example a cellular phone has been established by a gasket or an o-ring positioned between a substantially plane exterior surface part of the microphone and a substantially plane inner surface part of the housing. In order to provide an efficient acoustic seal the miniature microphone is mechanically biased towards the housing by a set of resilient members, such as spring members. This ensures that the microphone casing, gasket (or o-ring) and housing are constantly in contact with each other thereby an efficient acoustic seal is established.

Obviously, the above-mentioned prior art arrangement is a rather space consuming arrangement. Furthermore, with the recent development of surface mount compatible micro-machined silicon microphones the prior art assembly and mounting techniques are inconvenient and time-consuming in the manufacturing process of portable communication devices which to a large extent is based on automated assembly technology.

Therefore, there is a need for an automated assembly solution which supports use of surface mount compatible miniature microphones. This solution should furthermore be suitable for reflow soldering processes at temperatures around 275° C.

SUMMARY OF THE INVENTION

The above-mentioned object is complied with by providing, in a first aspect, an elastic microphone shield comprising:

an acoustic channel having a sound inlet and a sound outlet; and a hollow portion adapted to at least partly surround an associated miniature microphone casing, wherein the sound outlet of the acoustic channel is alignable with a sound inlet of the associated miniature microphone casing.

In a second aspect, the present invention relates to an elastic microphone shield comprising:

an acoustic channel having a sound inlet and a sound outlet; and a hollow portion having an inner surface adapted to fit at least part of an associated casing of an associated miniature microphone, wherein the sound outlet of the acoustic channel is alignable with a sound inlet of the associated miniature microphone.

The elastic shield may be fabricated from a rubber-like material so as to achieve proper elastic and resilient properties. The acoustic channel may in principle take any shape but for most applications the acoustic channel may be constituted by a through-going linear opening across an upper portion of the elastic shield. The upper portion is here to be understood as that part of the elastic shield that is arranged between the miniature microphone and an inner surface of a housing of for example a cellular phone. The elastic shield may be manufactured by compression moulding, injection moulding or similar techniques.

In order to provide EMI and ESD protection the elastic shield may comprise an electrically conductive material, such as a carbon compound. This electrically conductive material may be homogeneously distributed in the entire elastic shield. Alternatively, the electrically conductive material may be distributed in a manner where a certain portion or portions of the elastic shield comprise a higher concentration of electrically conductive material compared to other portions of the elastic shield.

The elastic shield may further comprise a mesh arranged within the acoustic channel so as to provide specific acoustical properties. The mesh may be a substantially planar disc-shaped member covering the entire or only part of the acoustic channel in a plane substantially perpendicular to a longitudinal direction of the acoustic channel. The mesh may comprise the material Nickel. The thickness of the mesh, in the longitudinal direction of the acoustic channel, may be less than 0.5 mm, such as less than 0.1 mm, such as less than 0.05 mm, such as approximately 0.02 mm. The mesh may engage with one or more tracks formed in the shield so as ensure a fixed relationship between the mesh and the acoustic channel.

In a third aspect, the present invention relates to a miniature microphone assembly comprising:

a miniature microphone comprising a casing having a sound inlet arranged therein; and an elastic shield comprising an acoustic channel having a sound inlet and a sound outlet, the elastic shield further comprising a hollow portion surrounding at least part of the miniature microphone casing in a manner so that the sound outlet of the acoustic channel is aligned with the sound inlet of the miniature microphone casing.

Preferably, the miniature microphone is adapted for surface mounting thus being a surface mountable device. More preferably, the miniature microphone assembly is suitable for automatic handling and capable of withstanding standard reflow soldering processes.

Again, the elastic shield may comprise an electrically conductive material, such as carbon, in order increase EMI and ESD protection. Preferably, the elastic properties of the elastic shield secure that at least part of the miniature microphone is kept in position in the hollow portion of the elastic shield. For most applications the elastic shield covers a majority of the exterior surface parts of the microphone assembly. Only the mounting surface of the miniature microphone and opening provided by the acoustic channel may be left non-covered.

Similar to the first and second aspects of the present invention, the elastic shield of the miniature microphone assembly may further comprise a mesh arranged within the acoustic channel so as to provide specific acoustical properties. The mesh may be a substantially planar disc-shaped member covering the entire or only part of the acoustic channel in a plane substantially perpendicular to a longitudinal direction of the acoustic channel. The mesh may comprise the material Nickel. The thickness of the mesh, in the longitudinal direction of the acoustic channel, may be less than 0.5 mm, such as less than 0.1 mm, such as less than 0.05 mm, such as approximately 0.02 mm. The mesh may engage with one or more tracks formed in the shield so as ensure a fixed relationship between the mesh and the acoustic channel.

In a fourth aspect, the present invention relates to a portable communication device comprising a housing having a sound inlet arranged therein, the portable communication device further comprising a miniature microphone assembly according to the third aspect of the present invention.

The portable communication device may in principle be any kind of communication device such as a cellular phone, a PDA or any combination thereof. The sound inlet arranged in the housing may be aligned with the sound inlet of the acoustic channel so that audible signals, such as speech, generated outside the housing of the portable communication device is allowed to enter the acoustic channel so as to be guided to the sound inlet of the miniature microphone. Preferably, the elastic properties of the elastic shield secure at least part of the miniature microphone in the hollow portion of the elastic shield.

Preferably, an exterior surface part of the elastic shield abuts an inner surface part of the housing of the communication device so as to form an acoustic seal between the acoustic channel and an interior volume of the communication device. Thus, an inner surface part of the housing of the communication device may contact and compress an exterior surface part of the elastic microphone shield so as to form an acoustically sealed channel between the sound inlet of the miniature microphone casing and the sound inlet of the portable communication device.

As mentioned with previous aspects, the miniature microphone is preferably a surface mountable device. The miniature microphone may comprise a substantially plane surface having disposed thereon a number of electrical contact pads adapted to contact corresponding contacts of a carrier substrate. Via these contact pads electrical power supply signals, analogue or digital output signals in form of differential or balanced output signals, clock signals etc. may be provided.

Preferably, the elastic shield comprises an electrically conductive material, such as carbon. The interior of the housing of the portable communication device may comprise a carrier substrate, such as a PCB, with an exposed electrically conducting pattern arranged thereon. A peripheral end contour of the elastic shield may form an electrical connection to the exposed electrically conducting pattern so as to form an electrical connection between the elastic shield and the exposed electrically conducting pattern on the carrier substrate.

In a fifth aspect, the present invention relates to a portable communication device comprising:

a housing having a sound inlet arranged therein, a miniature microphone comprising a casing having a sound inlet arranged therein, the miniature microphone being arranged within an interior volume of the housing, and an elastic shield comprising an acoustic channel arranged so as to guide audible signals from the sound inlet in the housing to the sound inlet in miniature microphone casing, the elastic shield further comprising a hollow portion surrounding at least part of the miniature microphone casing.

In a sixth aspect, the present invention relates to a portable communication device comprising:

a housing having a sound inlet arranged therein, a miniature microphone comprising a casing having a sound inlet arranged therein, the miniature microphone being arranged within an interior volume of the housing, and an elastic shield comprising an acoustic channel, the elastic shield being arranged so as to provide an acoustical seal between the acoustic channel and the interior volume of the housing, the elastic shield further comprising a hollow portion surrounding at least part of the miniature microphone casing.

BRIEF DESCRIPTION OF THE INVENTION

Figure 2:
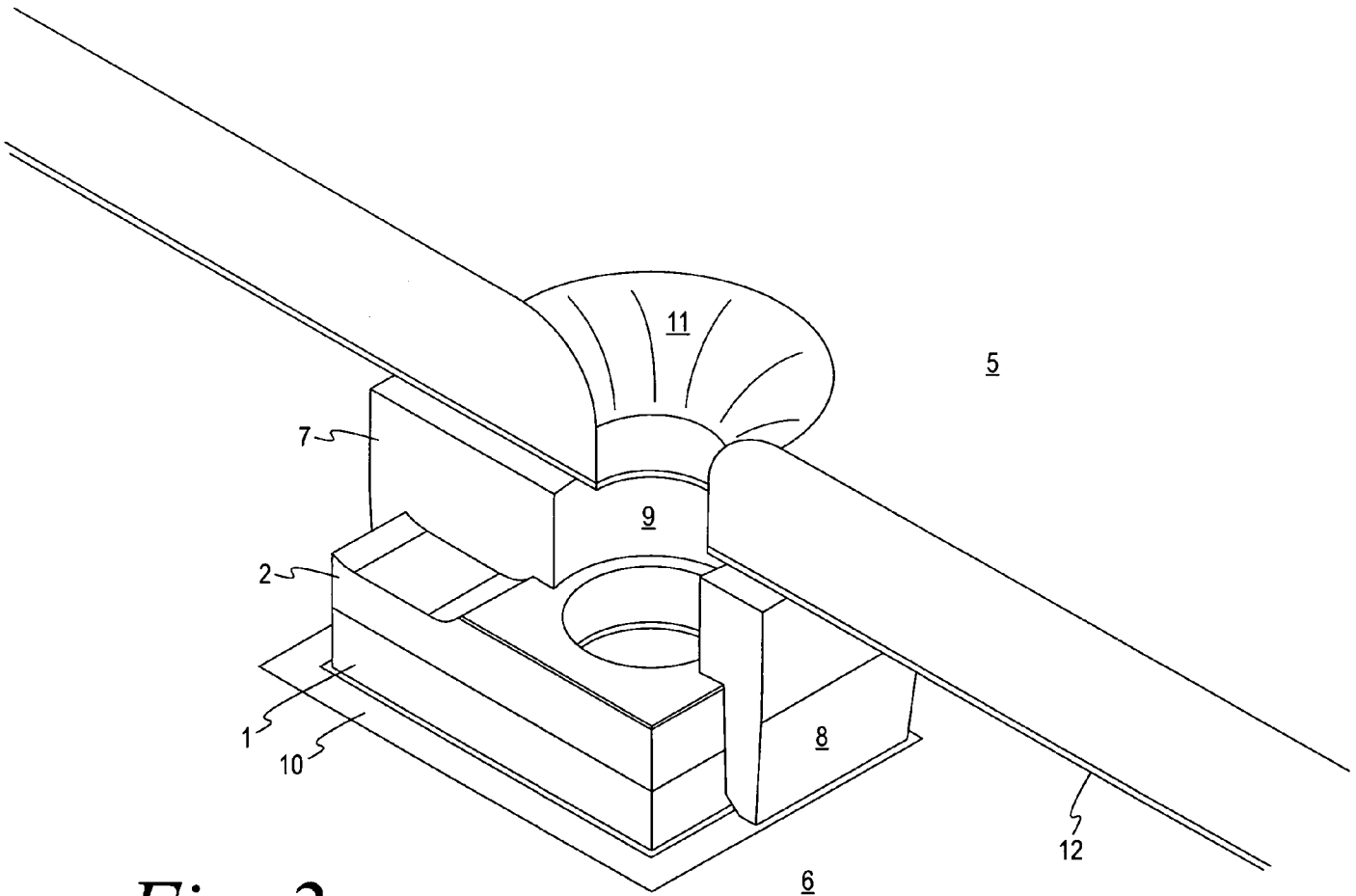

The present invention will now be described in further details with reference to the accompanying figures, wherein FIG. 1 shows a miniature microphone suitable for surface mounting, FIG. 2 shows a miniature microphone with an elastic shield attached thereto, and FIG. 3 shows a miniature microphone arranged in an elastic shield including a Nickel mesh positioned in an acoustic channel.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION OF THE INVENTION

In its broadest aspect the present invention relates to an arrangement in the form of an elastic shield which is capable of providing an acoustic seal between an acoustic channel and an interior volume of a portable device, such as the interior volume of a cellular phone. The acoustic seal is essential for prevented acoustic feedback to occur between the loudspeaker of the cellular phone and the microphone of the cellular phone. In addition to establishing the acoustic seal the elastic shield comprises a hollow portion adapted to receive and hold at least a portion of a miniature microphone, such as a surface mountable silicon microphone. The elastic shield and the miniature microphone are kept in a fixed mutual relationship by the elastic properties of the elastic shield in that the hollow portion of the elastic shield has dimensions slightly smaller than the corresponding parts of the miniature microphone. Thus, the elastic shield and the miniature microphone are kept in a fixed mutual relationship due to forces applying by the elastic shield to the miniature microphone. This arrangement also ensures a correct mutual alignment of the elastic shield relative to the miniature microphone.

The elastic shield according to the present invention also provides a shock absorbing protection to the miniature microphone in case the cellular phone is accidentally dropped. Furthermore, EMI and ESD protection of the miniature microphone is preferably provided in that the elastic shield according to the present invention comprises an electrical conductive elastomeric material or composition, such as a carbon based compound. Finally, the elastic shield absorbs component and distance tolerances in that the elastic shield may absorb tolerances on the miniature microphone and on the distance between a PCB and the inner surface of a housing of for example a cellular phone or another type of portable communication device.

Referring now to FIG. 1 a miniature microphone for surface mounting is depicted. Thus, the depicted miniature microphone is a surface mounting device (SMD) capable of withstanding reflow processes. FIG. 1*a* shows a bottom view of the miniature microphone which is constituted by a lower part 1 and an upper part 2. The lower part 1 is adapted to abut the printed circuit board (PCB) upon which it has been mounted. The surface mounting of the miniature microphone is established using standard reflow processes at temperatures of around 250° C. In FIG. 1*a* six contact pads 3 are arranged on a substantially plane surface of the lower part 1. These contacts pads are used for various purposes, such as supplying the miniature microphone with power from the PCB, transporting various data to and/or from the miniature microphone etc. Obviously the number of contact pads may differ from six and it may thus be adjusted for specific applications.

FIG. 1*b* shows a top view of the same miniature microphone. An opening 4 is formed in the upper part 2 of the miniature microphone. This opening 4 allows audible signals to reach the lower part 2 of the miniature microphone where a pressure sensitive element or elements are positioned.

The miniature microphone has a footprint of only 2.6×1.6 $mm^2$ (and a height of only 0.84 mm) and is thus ideal for applications where minimum microphone size is a key issue. Typical dimensions of the elastic shield are 3.19×2.19×1.92 $mm^3$ (L×B×H) with a sound inlet opening in the range 0.8-1.2 mm, such as 1.02 mm, in diameter. Obviously, the dimensions of the miniature microphone and the elastic shield may differ from the above-specified numbers.

The miniature microphone, which is SMT compliant, integrates a microphone chip and an ASIC assembled onto a carrier chip to form a single pinhead-sized "all-silicon" component. The microphone chip holds the acoustic sensor structure and the ASIC contains a bias-circuit, a low-noise pre-amplifier and a sigma-delta-based A/D converter. The output is a single-bit digital output stream that can be connected to downstream digital electronics for a high degree of flexibility and freedom. An important benefit of the all-silicon miniature microphone is its reduced susceptibility to temperature and humidity, as well as its high immunity to electromagnetic interference (EMI). The closely integrated microphone and ASIC in a sealed, all-silicon chip scale package, dramatically reduces parasitic electrical elements, while the digital output eliminates EM interference for transmission over long distances. This allows product designers flexibility in the system design in e.g. a mobile phone, including the possibility to implement arrays of microphones for directionality or noise cancellation.

The key features of the miniature microphone can be summarized as follows:

a. Size, all silicon package and surface mountability—ease manufacturing costs and increase efficiency.
b. Integrated solution—integrated microphone, analogue pre-amplifier and sigma-delta modulator reduce component count and board space, as well as RF/EM interference.
c. High suppression of RF and EM interference—digital output (differential or balanced output) eliminates EM interference over long transmission distances enabling microphone arrays that increase performance.
d. Digitalization—enables high performance microphone array applications.
e. Left/Right feature enabling stereo application over a single data wire.
f. In an alternative configuration, the miniature microphone can be equipped with an analogue output stage whereby differential or balanced analogue signals can be provided for further processing.

Referring now to FIG. 2 a miniature microphone comprising two parts 1, 2, a PCB 6, a part of an elastic shield comprising two parts 7, 8 and a housing portion 5 with a sound inlet 11 arranged therein are depicted. The housing portion 5 may be part of a housing of for example a cellular phone or another portable communication device. The working distance between the most upper surface of the miniature microphone and the inner surface of the housing is typically around 1.6 mm.

Before surface mounting the miniature microphone 1, 2 the elastic shield 7, 8 is attached to the microphone. As previously mentioned the elastic shield 7, 8 is kept in position by the elastic properties of the elastic shield itself in that especially the lower part 8 of the elastic shield apply inwardly directed forces to exterior surfaces of the microphone. The elastic shield is designed to withstand forces applied by automatic handling techniques and to withstand reflow temperatures. Thus, an assembly comprising a miniature microphone with an elastic shield attached thereto, and optionally with a Nickel mesh arranged in the acoustic channel, can be handled as a standard SMD component and is, in addition, capable of being reflowed at temperature of around 275° C. for 60 seconds with less than 10% degradation in acoustical, electrical or mechanical performance.

Between the housing portion 5 and the miniature microphone 1, 2 the upper part 7 of the elastic shield is positioned. This part of the elastic shield has an acoustic channel 9 arranged therein so that audible signals may be guided from the inlet 11 in the housing portion 5 to the pressure sensitive element of the miniature microphone. In order for the upper part 7 to form an efficient acoustic seal the PCB 6 and the housing portion 5 are mechanically biased towards each other whereby the upper part 7 of the elastic shield becomes slightly compressed by these biasing forces.

The elastic shield depicted in FIG. 2 is illustrated as being constituted by two parts—an upper part 7 having an acoustic channel 9 arranged therein and the lower part 8 surrounding the exterior of the miniature microphone. Thus, the upper part 7 forms the acoustic sealing between the acoustic channel 9 and the interior volume of e.g. a cellular phone whereas the lower part 8 maintains the fixed mutual relationship between the miniature microphone and the elastic shield 7, 8. The upper and lower parts 7, 8 may be fabricated separately and thereafter assembled using appropriate means. Alternatively, the entire elastic shield can be manufactured as a single-piece elastic shield.

As previously mentioned, EMI and ESD protection is preferably provided by applying an electrical conductive elastomeric material or composition such as a carbon filled elastomer. To complete the EMI and ESD protection an electrically conductive ring 10 (see FIG. 2) is arranged on the PCB. The electrically conductive ring 10 encircles those PCB contact pads which are adapted to provide the necessary electrical connections between the PCB and the SMD compatible miniature microphone. To provide additional ESD protection the inner surface of the housing 5 can be covered by an electrically conductive layer 12 which, for the same reason, is connected to ground or alternative, to a low impedance node of an electronic circuit positioned within the housing 5. The electrical connection to ground or to the low impedance node also applies to the electrically conducting ring 10.

Figure 3A:
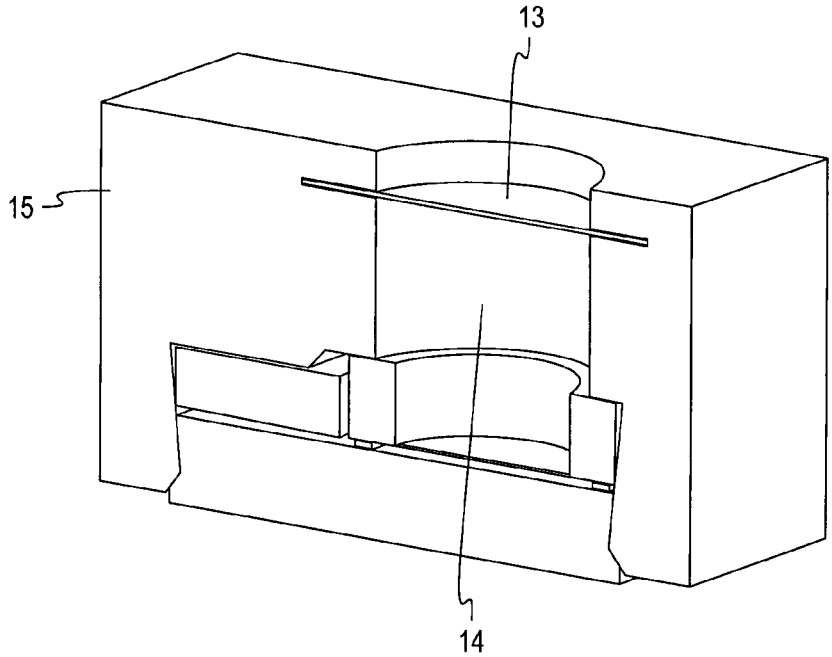

FIG. 3*a* depicts an embodiment of the present invention where the Nickel mesh 13 is positioned within the acoustic channel 14. As depicted in FIG. 3 the Nickel mesh is kept in position by engaging through tracks arranged in the shield 15. The Nickel mesh may be designed to have specific or customized acoustical properties. The thickness of the Nickel mesh shown in FIG. 3 is 0.02 mm. The sheet resistance of the Nickel mesh is 4.6 mΩ/square.

Figure 3B:
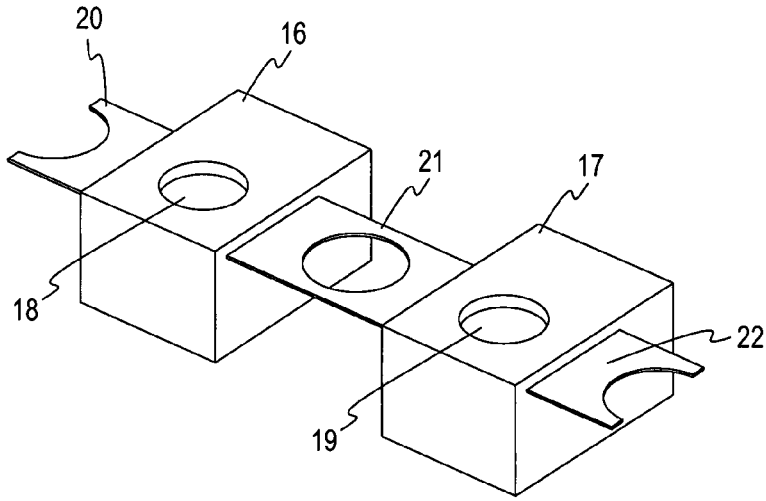

FIG. 3*b* shows how Nickel meshes can be provided during manufacturing of elastic shields 16, 17. As depicted in FIG. 3*b* a string of Nickel meshes 18, 19 can be inserted into through-going tracks of aligned elastic shields 16, 17. After insertion of the string of Nickel meshes into the plurality of elastic shields the intermediate parts 20, 21, 22 of the string is removed thereby separating the elastic shields 16, 17.

The invention claimed is:

1. A portable communication device comprising a housing with a sound inlet arranged therein, the portable communication device further comprising a miniature microphone assembly including:

a miniature microphone comprising a casing having a sound inlet arranged therein, and an elastic shield comprising an acoustic channel having a sound inlet and a sound outlet, the elastic shield further comprising a hollow portion surrounding at least part of the miniature microphone casing in a manner so that the sound outlet of the acoustic channel is aligned with the sound inlet of the miniature microphone casing, the elastic shield being composed of an electrically conductive material including carbon that is homogenously distributed in the entire elastic shield, wherein the interior of the housing of the portable communication device comprises a carrier substrate with an exposed electrically conducting pattern arranged thereon, wherein a peripheral end contour of the elastic shield forms an electrical connection to the exposed electrically conducting pattern so as to form an electrical connection between the elastic shield and the exposed electrically conducting pattern on the carrier substrate, and wherein the miniature microphone includes a mounting surface with contact pads that are adapted to be surface mounted to a printed circuit board.

2. A portable communication device according to claim 1, wherein the elastic shield surrounds exterior surfaces of the miniature microphone casing except a mounting surface opposite the sound inlet.

3. A portable communication device according to claim 1, wherein the elastic properties of the elastic shield secure at least part of the miniature microphone in the hollow portion of the elastic shield.

4. A portable communication device according to claim 1, wherein the elastic shield further comprises a mesh arranged within the acoustic channel.

5. A portable communication device according to claim 4, wherein the mesh comprises Nickel, and wherein a thickness of the mesh, in a longitudinal direction of the acoustic channel, is less than 0.5 mm.

6. A portable communication device according to claim 4, wherein the mesh engages with one or more tracks in the elastic shield so as to ensure a fixed relationship between the mesh and the acoustic channel.

7. A portable communication device according to claim 1, wherein the sound inlet arranged in the housing of the portable communication device is aligned with the sound inlet of the acoustic channel.

8. A portable communication device according to claim 1, wherein an inner surface part of the housing of the communication device contacts and compresses an exterior surface part of the elastic microphone shield so as to form an acoustically sealed channel between the sound inlet of the miniature microphone casing and the sound inlet of the portable communication device.

9. A portable communication device according to claim 1, wherein the miniature microphone comprises a substantially plane surface having disposed thereon a number of electrical contact pads adapted to contact corresponding contacts of a carrier substrate.

10. A portable communication device according to claim 1, wherein the elastic shield comprises an electrically conductive material.

11. A portable communication device comprising:

a housing having a sound inlet arranged therein, a miniature microphone comprising a casing having a sound inlet arranged therein, and an elastic shield comprising an acoustic channel having a sound inlet and a sound outlet, the elastic shield further comprising a hollow portion surrounding at least part of the miniature microphone casing in a manner so that the sound outlet of the acoustic channel is aligned with the sound inlet of the miniature microphone casing, the elastic shield being composed of an electrically conductive material homogenously distributed in the entire elastic shield, wherein the miniature microphone includes a mounting surface with contact pads that are adapted to be surface mounted to a printed circuit board, wherein the interior of the housing of the portable communication device comprises a carrier substrate with an exposed electrically conducting pattern arranged thereon, and wherein a peripheral end contour of the elastic shield forms an electrical connection to the exposed electrically conducting pattern so as to form an electrical connection between the elastic shield and the exposed electrically conducting pattern on the carrier substrate.

12. A portable communication device comprising a housing with a sound inlet arranged therein, the portable communication device further comprising a miniature microphone assembly including:

a miniature microphone comprising a casing having a sound inlet arranged therein, and an elastic shield comprising an acoustic channel having a sound inlet and a sound outlet, the elastic shield further comprising a hollow portion surrounding at least part of the miniature microphone casing in a manner so that the sound outlet of the acoustic channel is aligned with the sound inlet of the miniature microphone casing, the elastic shield being composed of an electrically conductive material including carbon that is homogenously distributed in the entire elastic shield, wherein the interior of the housing of the portable communication device comprises a carrier substrate with an exposed electrically conducting pattern arranged thereon, wherein a peripheral end contour of the elastic shield forms an electrical connection to the exposed electrically conducting pattern so as to form an electrical connection between the elastic shield and the exposed electrically conducting pattern on the carrier substrate, and wherein the elastic shield surrounds exterior surfaces of the miniature microphone casing except a mounting surface opposite the sound inlet.

13. A portable communication device comprising a housing with a sound inlet arranged therein, the portable communication device further comprising a miniature microphone assembly including:

a miniature microphone comprising a casing having a sound inlet arranged therein, and an elastic shield comprising an acoustic channel having a sound inlet and a sound outlet, the elastic shield further comprising a hollow portion surrounding at least part of the miniature microphone casing in a manner so that the sound outlet of the acoustic channel is aligned with the sound inlet of the miniature microphone casing, the elastic shield being composed of an electrically conductive material including carbon that is homogenously distributed in the entire elastic shield, wherein the interior of the housing of the portable communication device comprises a carrier substrate with an exposed electrically conducting pattern arranged thereon, wherein a peripheral end contour of the elastic shield forms an electrical connection to the exposed electrically conducting pattern so as to form an electrical connection between the elastic shield and the exposed electrically conducting pattern on the carrier substrate, and wherein the miniature microphone comprises a substantially plane surface having disposed thereon a number of electrical contact pads adapted to contact corresponding contacts of a carrier substrate.

* * * * *